US008607503B2

(12) United States Patent
Ivie

(10) Patent No.: US 8,607,503 B2
(45) Date of Patent: Dec. 17, 2013

(54) ADVENTURE DOOR

(76) Inventor: Calvin L. Ivie, Oregon House, CA (US)

( * ) Notice: Subject to any disclaimer, the term of this patent is extended or adjusted under 35 U.S.C. 154(b) by 0 days.

(21) Appl. No.: 13/427,581

(22) Filed: Mar. 22, 2012

(65) Prior Publication Data

US 2013/0247467 A1 Sep. 26, 2013

(51) Int. Cl.
*E06B 5/10* (2006.01)

(52) U.S. Cl.
USPC ..... 49/67; 49/55

(58) Field of Classification Search
USPC ..... 49/70, 50, 55, 57, 61, 63, 67; 40/541, 40/550, 540, 452
See application file for complete search history.

(56) References Cited

U.S. PATENT DOCUMENTS

| | | | | | |
|---|---|---|---|---|---|
| 4,602,448 | A * | 7/1986 | Grove | 40/541 |
| 4,970,812 | A * | 11/1990 | Tanaka et al. | 40/452 |
| 5,212,907 | A * | 5/1993 | Van Sandt | 49/70 |
| 5,575,098 | A * | 11/1996 | Goettel-Schwartz | 40/550 |
| 5,632,514 | A * | 5/1997 | Johnson, Jr. | 292/95 |
| 5,636,462 | A * | 6/1997 | Kleiman | 40/452 |
| 6,089,301 | A * | 7/2000 | Smith | 160/90 |
| 6,865,848 | B2 * | 3/2005 | Krimmel | 49/409 |
| 7,703,227 | B2 * | 4/2010 | Carlson | 40/541 |
| 2008/0079538 | A1 * | 4/2008 | Davis | 340/5.91 |
| 2010/0043293 | A1 * | 2/2010 | Nicholson et al. | 49/70 |
| 2012/0090241 | A1 * | 4/2012 | Alexander | 49/55 |
| 2012/0137551 | A1 * | 6/2012 | Limber | 40/544 |
| 2012/0285089 | A1 * | 11/2012 | Artwohl et al. | 49/70 |
| 2012/0304513 | A1 * | 12/2012 | Gorelick | 40/581 |

FOREIGN PATENT DOCUMENTS

| | | | | |
|---|---|---|---|---|
| GB | 2129473 A | * | 5/1984 | E06B 9/02 |

* cited by examiner

*Primary Examiner* — Jerry Redman
(74) *Attorney, Agent, or Firm* — Kilpatrick Townsend & Stockton LLP

(57) ABSTRACT

A half-sized adventure door suitable for entry ways to rooms occupied by children is described. The half-door provides a substitute to the costly modification of existing doors in child-care centers and pre-schools while being in compliance with laws and regulations. The half-door decreases costs and risk of damage to existing structure as compared to other ways of implementing a half-door, and doing so while nurturing the imagination of children with a theme. The half-door is constructed to be attached to any standard interior house door-jamb using self-adhesive tape such that no tools are required and damage to existing structure can be mitigated. When the half-door is opened, lights will flash and music will sound. The music and light colors can be coordinated to match the various themes available.

7 Claims, 2 Drawing Sheets

ADVENTURE DOOR

CROSS-REFERENCE

Not applicable

STATEMENT OF FEDERALLY SPONSORED RESEARCH/DEVELOPMENT

Not Applicable

BACKGROUND OF THE INVENTION

Government regulation of day care centers and pre-schools require that all entry doors to rooms occupied by children attending these facilities be locked open. The spaces affected include, but not limited to: sleeping/nap rooms, restrooms, classrooms, indoor playrooms, eating areas, etc.

U.S. Pat. No. 4,316,345 to Rivette shows a toy decorative curtain/door that is meant to be put up temporarily between the vertical jambs of a door. It is a flexible curtain and is mounted on a roller so it can be rolled up when not in use. This system would be forbidden by state law for use in day care centers and pre-schools because it covers the entire doorjamb, preventing an adult from observing the occupied room without permanently drawing up the curtain while the room is occupied, defeating the intent of offering some modicum of privacy.

U.S. Pat. No. 4,787,174 to Brown shows a child safety door that has decorative panels which expand to securely engage a door jam. This system would also be forbidden by state law for use in day care and preschools because the door is securely engaged in the door jamb, preventing a child from exiting the room.

Thus, neither the decorative curtain/door of Rivette nor the child safety door of Brown complies with government regulation on entry doors to rooms occupied by children.

Embodiments of the present invention address these and other problems.

SUMMARY OF THE INVENTION

Embodiments of the present invention provide a half-door assembly for installation on an existing doorjamb without requiring removal or replacement of an existing door attached to the existing doorjamb. The half-door assembly can include a jamb, a privacy half-door panel, and an adjustable width extender. The jamb includes a self-adhesive material disposed on one side and is used for attaching the half-door assembly to an existing doorjamb without tools. The jamb also includes a set of hinges that is attached to the privacy half-door panel. The privacy half-door panel has a height that is less than a height of the location of a doorknob on the existing door. The adjustable width extender attached to a closing side of the privacy half-door panel is free of any door latching mechanism, preventing the half-door assembly from being latched to the existing doorjamb and allowing the privacy half-door panel to freely open and close in an unlatched state.

DETAILED DESCRIPTION OF THE INVENTION

Presently, to comply with government regulation, day care centers and pre-school operators have been using professional carpenters to modify existing room doors, having them cut in half and reinstalled as a half door. The costs of using professional carpenters can be high. Furthermore, the modified doors, once installed, cannot be easily removed to put the entry way back in its original state. Embodiments of the present invention provide a low cost alternative that meets regulatory requirements for those facilities.

Figure 1:
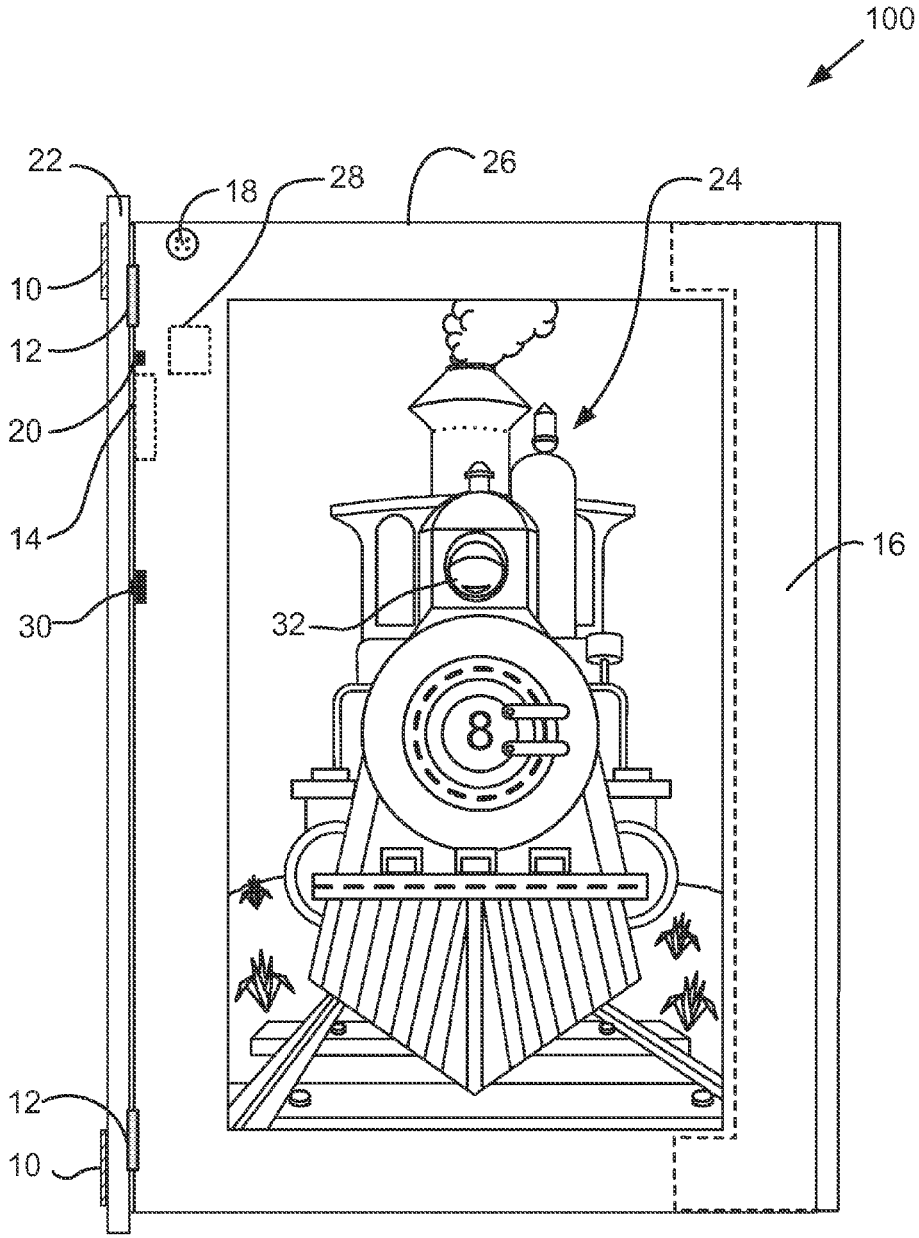
FIG. 1 illustrates a front view of a half-door with a sample locomotive theme, according to an embodiment.

Embodiments of the present invention provide a half-door that complies with government regulation while still offering some amount of privacy to the children in an occupied room, and still enabling adults to physically observe the activities in the occupied room from outside that room. The half-door according to embodiments of the invention can fit in a typical interior standard existing doorjamb of a bedroom, bathroom or playroom. The half-door may be attached and removed, without tools, from any interior standard doorjamb. The facings of the half-door can be designed with a variety of themes (e.g., FIG. 1 shows a locomotive theme). According to some embodiments, when the door is opened, a battery operated sound and light module will activate LED lights and music customized to one of the various themes. The combination of lights and sound is used to alert an adult that the half-door has been opened. Embodiments of the invention can be provided to a user preassembled. The user mounts the half-door to the existing doorjamb using pre-mounted self-stick tape, then adjusts an adjustable width extender so that the half-door fits properly, filling the entire width of the existing doorjamb.

Referring to FIG. 1, the half-door assembly according to various embodiments includes a jamb 22 for mounting the half-door to an existing doorjamb, a half-door panel 26 (also referred to as a "privacy half-door panel") to provide some privacy to children occupying a room when the half-door is in the closed position, and an adjustable width extender 16 to adjust the width of the half-door to fit the width of the entry way defined by an existing door frame.

Jamb 22 includes a self-adhesive material 10 (e.g., self-adhesive tape) disposed on a mounting side of the jamb, which is the side that mounts the half-door assembly 100 to an existing doorjamb. The self-adhesive material 10 allows the half-door assembly 100 to be mounted to an existing doorjamb without tools. Jamb 22 also includes a set of hinges 12 disposed on a second side of jamb 22 opposing the mounting side. In some embodiments, hinges 12 are self-closing hinges.

Privacy half-door panel 26 is attached to hinges 12 on the hinge side of privacy half-door panel 26, which is the side that half-door panel 26 pivots around. The height of privacy half-door panel 26 is designed to be less than the height of the location of the doorknob of an existing door. This allows half-door assembly 100 to be installed on an existing doorjamb and to fit under the doorknob of an existing door without requiring the removal or replacement of the existing door. The base of privacy half-door panel 26 is positioned higher than the base of jamb 22 to provide a clearance gap at the base of privacy half-door panel 26. For example, according to some embodiments, the base of jamb 22 is ¾ of an inch longer than the base of privacy half-door panel 26 to help the privacy half-door panel 26 clear any flooring.

Adjustable width extender 16 is attached to the closing side of privacy half-door panel 26, which is the side opposing the hinge side of privacy half-door panel 26. Adjustable width extender 16 allows the width of the half-door to be adjusted by sliding adjustable width extender 16 in or out to fit the width of the entry way. In some embodiments, adjustable width extender 16 is a plastic extender piece. As can be seen in FIG. 1, adjustable width extender 16 is free of any door latching mechanism to prevent the closing side of the half-door from being latched to the existing doorjamb and to allow privacy half-door panel 26 to freely open and close in an unlatched state. Thus, the half-door according to various embodiments fully comply with regulations that require entry way to rooms occupied by children to be left unlocked such that children can freely enter or exit the room, because the half-door lacks any latching mechanism that can be used to locked the half-door closed.

According to some embodiments, privacy half-door panel 26 can be made from pressed or formed plastic, and can be provided with a theme (e.g., a locomotive theme as shown) suitable for children on a facing of privacy half-door panel 26. The pressed or formed plastic can give the theme a two or three dimensional feel and look. In some embodiments, privacy half-door panel 26 also includes a speaker 18 and lights 32 on a facing of privacy half-door panel 26. Speaker 18 can be placed inside privacy half-door panel 26, and small-perforated holes can be provided on the facing so sound from speaker 18 can be heard.

Privacy half-door panel 26 also includes a sound and light module 28 for controlling speaker 18 and lights 32. Privacy half-door panel 26 can include a push-button switch 30 on the hinge side of privacy half-door panel 26 as shown in FIG. 1. Push-button switch 30 is used to detect whether the half-door is in the closed or opened position. When half-door panel 26 opens (e.g., when a child walks through the entry way), push-button switch 30 sends a signal to sound and light module 28 to activate speaker 18 and lights 32 to sound off lights and sound for effect. The lights and sound can be set to correspond to the particular theme 24 on the facing of privacy half-door panel 26.

To power sound and light module 28, speaker 18, and lights 32, a battery compartment 14 to house batteries can be provided on the inside of the hinge side of half-door panel 26 as shown in FIG. 1. Battery compartment 16 is accessible for changing the batteries. Half-door panel 26 can also include a master on/off switch 20 to turn sound and lights off, so that half-door panel 26 can be opened without having the sound and lights turn on.

Figure 2:
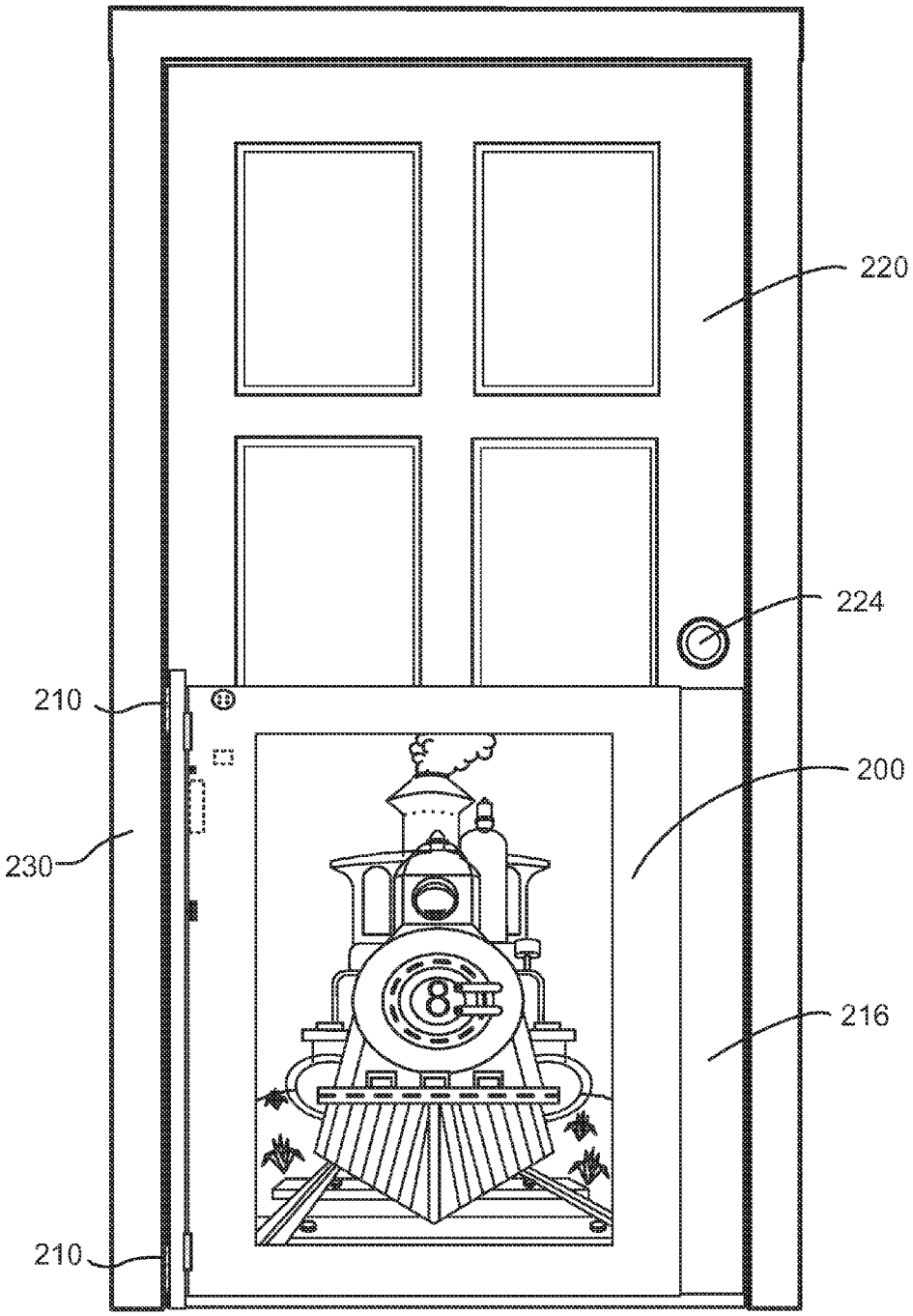
FIG. 2 illustrates a front view of a half-door attached to an existing doorjamb, according to an embodiment.

FIG. 2 illustrates half-door 200 attached to an existing doorjamb 210, according to an embodiment. Half-door 200 is mounted to existing doorjamb 210 via self-adhesive tape 210 as described above. Adjustable width extender 216 can be extended to fit the entry way as shown. As described above, the height of half-door 200 is less than the height of the location of doorknob 224 of the existing door 220. This allows the half-door 200 to be installed without requiring removal or replacement of existing door 220 because the installed half-door 200 does not interfere with the existing door 220. It should be noted that although existing door 220 is shown to be in the closed position for illustrative purposes in FIG. 2, when children are occupy the room behind existing door 220, existing door 220 is to remain opened such that an adult can observe the activities in the occupied room from outside. The children inside is still afford some level of private by half-door 220, and can enter or exit the room freely.

Thus, a half-sized adventure door suitable for entry ways to rooms occupied by children has been described. The half-door according to embodiments provides a substitute to the costly modification of existing doors in childcare centers and pre-schools while being in compliance with laws and regulations. The half-door decreases costs and risk of damage to existing structure as compared to other ways of implementing a half-door, and doing so while nurturing the imagination of children with a theme. The half-door is constructed to be attached to any standard interior house doorjamb using self-adhesive tape such that no tools are required and damage to existing structure can be mitigated. When the half-door is opened, lights will flash and music can sound. The music and light colors can be coordinated to match the various themes available.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

I claim:

1. A half-door assembly for installation on an existing doorjamb without requiring removal or replacement of an existing door attached to the existing doorjamb, the half-door assembly comprising:

a jamb including:

a self-adhesive material disposed on a first side of the jamb, the self-adhesive being used to attach the half-door assembly to the existing doorjamb without tools; and a set of hinges disposed on a second side of the jamb opposing the first side of the jamb;

a privacy half-door panel attached to the set of hinges on a hinge side of the privacy half-door panel, the privacy half-door panel having a height that is less than a height of a location of a doorknob on the existing door; and an adjustable width extender attached to a closing side of the privacy half-door panel opposing the hinge side of the privacy half-door panel, the adjustable width extender being free of any door latching mechanism, preventing a closing side of the half-door assembly from being latched to the existing door jamb and allowing the privacy half-door panel to freely open and close in an unlatched state.

2. The half-door assembly of claim 1, wherein the privacy half-door panel further includes:

a push-button switch on the hinge side of the privacy half-door panel; and a sound and light module coupled to a speaker and lights on a facing of the privacy half-door panel, wherein the sound and light module activates the speaker and the lights upon opening of the half-door panel detected by the push-button switch.

3. The half-door assembly of claim 2, wherein the privacy half-door panel further includes a master on-off switch to disable the sound and light module.

4. The half-door assembly of claim 2, wherein the privacy half-door panel further includes a theme formed on the facing of the half-door panel.

5. The half-door assembly of claim 1, wherein the privacy half-door panel is made of plastic.

6. The half-door assembly of claim 1, wherein the set of hinges are self-closing hinges.

7. The half-door assembly of claim 1, wherein a base of the privacy half-door panel is positioned higher than a base of the jamb to provide a clearance gap at the base of the privacy half-door panel.

* * * * *